US007545344B2

(12) United States Patent
Ito

(10) Patent No.: US 7,545,344 B2
(45) Date of Patent: Jun. 9, 2009

(54) PLASMA DISPLAY DEVICE

(75) Inventor: Yukiharu Ito, Osaka (JP)

(73) Assignee: Panasonic Corporation, Osaka (JP)

( * ) Notice: Subject to any disclaimer, the term of this patent is extended or adjusted under 35 U.S.C. 154(b) by 513 days.

(21) Appl. No.: 10/557,100

(22) PCT Filed: May 24, 2005

(86) PCT No.: PCT/JP2005/009837

§ 371 (c)(1),
(2), (4) Date: Nov. 16, 2005

(87) PCT Pub. No.: WO2005/114627

PCT Pub. Date: Dec. 1, 2005

(65) Prior Publication Data

US 2007/0030213 A1 Feb. 8, 2007

(30) Foreign Application Priority Data

May 24, 2004 (JP) ..... 2004-152801

(51) Int. Cl.
*G09G 3/28* (2006.01)

(52) U.S. Cl. ..... 345/60; 315/169.4

(58) Field of Classification Search ..... 345/37, 345/60–68, 204; 315/169.1, 169.4
See application file for complete search history.

(56) References Cited

U.S. PATENT DOCUMENTS 6,853,145 B2 * 2/2005 Kang et al. ..... 315/169.1
2004/0080280 A1 4/2004 Hibino et al.

FOREIGN PATENT DOCUMENTS

| | | |
|---|---|---|
| CN | 1333907 A | 1/2002 |
| JP | 07-191623 A | 7/1995 |
| JP | 11-109915 | 4/1999 |
| JP | 11-282417 A | 10/1999 |

OTHER PUBLICATIONS

International Search Report for application No. PCT/JP2005/009837 dated Aug. 23, 2005.

* cited by examiner

*Primary Examiner*—Richard Hjerpe
*Assistant Examiner*—Mansour M Said
(74) *Attorney, Agent, or Firm*—RatnerPrestia

(57) ABSTRACT

The plasma display device comprises a plasma display panel forming discharge cells at intersections between data electrodes (D1-Dm) and both of scanning electrodes (SCN1-SCNn) and sustain electrodes (SUS1-SUSn), and a scanning electrode drive circuit for applying a specified voltage to the scanning electrodes (SCN1-SCNn), in which the scanning electrode drive circuit includes a scanning circuit connected to the scanning electrodes (SCN1-SCNn), an initializing circuit connected to the scanning circuit for generating an initializing waveform, and a sustain circuit connected to the scanning circuit for generating a sustain pulse, and is characterized by issuing a drive waveform in a lapse of specified time after turning on the power.

3 Claims, 3 Drawing Sheets

PLASMA DISPLAY DEVICE

THIS APPLICATION IS U.S NATIONAL PHASE APPLICATION OF PCT INTERNATIONAL APPLICATION PCT/JP2005/009837

TECHNICAL FIELD

The present invention relates to a plasma display device used in image display of television receiver, computer terminal, and others.

BACKGROUND ART

An alternating-current surface discharge type panel as a representative plasma display panel (PDP) has multiple discharge cells formed between oppositely disposed front board and rear board. The front board has a plurality of pairs of display electrodes consisting of a pair of scanning electrode and sustain electrode formed parallel to each other on a front glass substrate, and a dielectric layer and a protective layer are formed to cover these display electrodes. The rear board has a plurality of parallel data electrodes formed on a rear glass substrate, a dielectric layer to cover them, and a plurality of partition walls formed thereon parallel to the data electrodes, and a phosphor layer is formed on the surface of dielectric layer, and at the side of partition walls.

The front board and rear board are oppositely disposed and sealed so that display electrodes and data electrodes may intersect three-dimensionally, and the inside discharge space is filled with discharge gas. Discharge cells are formed in the opposing parts of display electrodes and data electrodes. In the panel having such configuration, ultraviolet rays are generated in each discharge cell by gas discharge, and the phosphors of RGB colors are excited and illuminated by the ultraviolet rays, and a color display is achieved.

A general method of driving the panel is sub-field method, in which one field period is divided into a plurality of sub-fields, and by combination of sub-fields to be illuminated, gradation display is made. In this method, by applying a writing pulse between the data electrode and scanning electrode, write discharge is conducted between the data electrode and scanning electrode. After selecting a discharge cell, by applying periodic sustain pulses inverting alternately between the scanning electrode and sustain electrode, sustain discharge is conducted between the scanning electrode and sustain electrode, and specified display is made.

Such driving method of panel in conventional plasma display panel is disclosed, for example, in Japanese Patent Application Laid-Open Publication No. H11-109915.

In such conventional plasma display device, however, initializing waveform may not be always issued right after turning on the power, and if the electric charge generated finally in the preceding time of power feed is left over in the discharge cells, these discharge cells are not initialized, and sustain discharge occurs by the first sustain operation after turning on the power, and undesired illumination may momentarily appear on the screen, which causes to lower the display quality.

DISCLOSURE OF THE INVENTION

The plasma display device of the invention comprises a plasma display panel forming discharge cells at intersections between data electrodes and both of scanning electrodes and sustain electrodes, and a scanning electrode drive circuit for applying a specified voltage to scanning electrodes. The scanning electrode drive circuit is characterized by issuing a drive waveform in a lapse of specified time after turning on the power.

The scanning electrode drive circuit includes a scanning circuit connected to the scanning electrodes, an initializing circuit connected to the scanning circuit for generating an initializing waveform, and a sustain circuit connected to the scanning circuit for generating a sustain pulse.

In this configuration, a specified period is provided from supply of power until output of driving waveform, and after output of initializing waveform, a sustain pulse is generated, and therefore the remaining electric charge in discharge cells is eliminated by the initializing operation, and undesired discharge does not occur in the subsequent sustain operation, so that the display quality in starting time can be enhanced.

DETAILED DESCRIPTION OF THE PREFERRED EMBODIMENTS

A preferred embodiment of plasma display device of the invention is described below while referring to FIG. 1 to FIG. 4.

Figure 1:
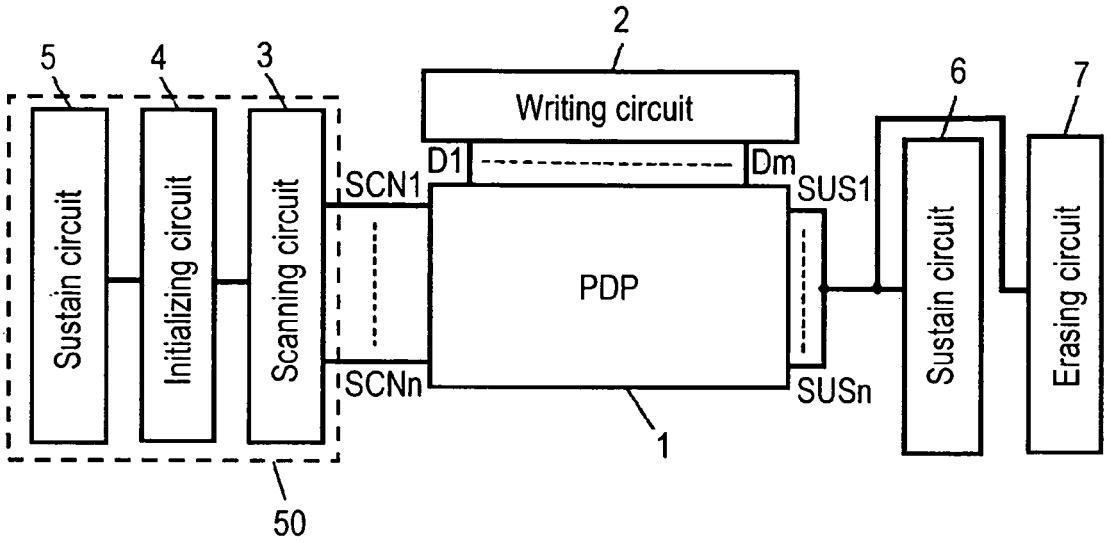
FIG. 1 is a block diagram of plasma display device in a preferred embodiment of the invention.

FIG. 1 is a block diagram of plasma display device in a preferred embodiment of the invention. In FIG. 1, a PDP 1 has a pair of transparent glass substrates disposed oppositely to form a discharge space between them, and has discharge cells (not shown) formed at intersections between data electrodes provided at the rear side substrate and both of scanning electrodes and sustain electrodes provided at the front side substrate.

From data electrode D1 to Dm of the PDP 1, a writing circuit 2 is connected for applying a specified writing pulse voltage to these data electrodes D1 to Dm. From scanning electrode SCN1 to SCNn, a scanning electrode drive circuit 50 composed of a scanning circuit 3 for applying a specified scanning voltage to these scanning electrodes SCN1 to SCNn, an initializing circuit 4, and a sustain circuit 5 is connected. From sustain electrode SUS1 to SUSn, a sustain electrode drive circuit composed of a sustain circuit 6 for applying a specified voltage to these sustain electrodes SUS1 to SUSn and an erasing circuit 7 is connected.

Figure 2:
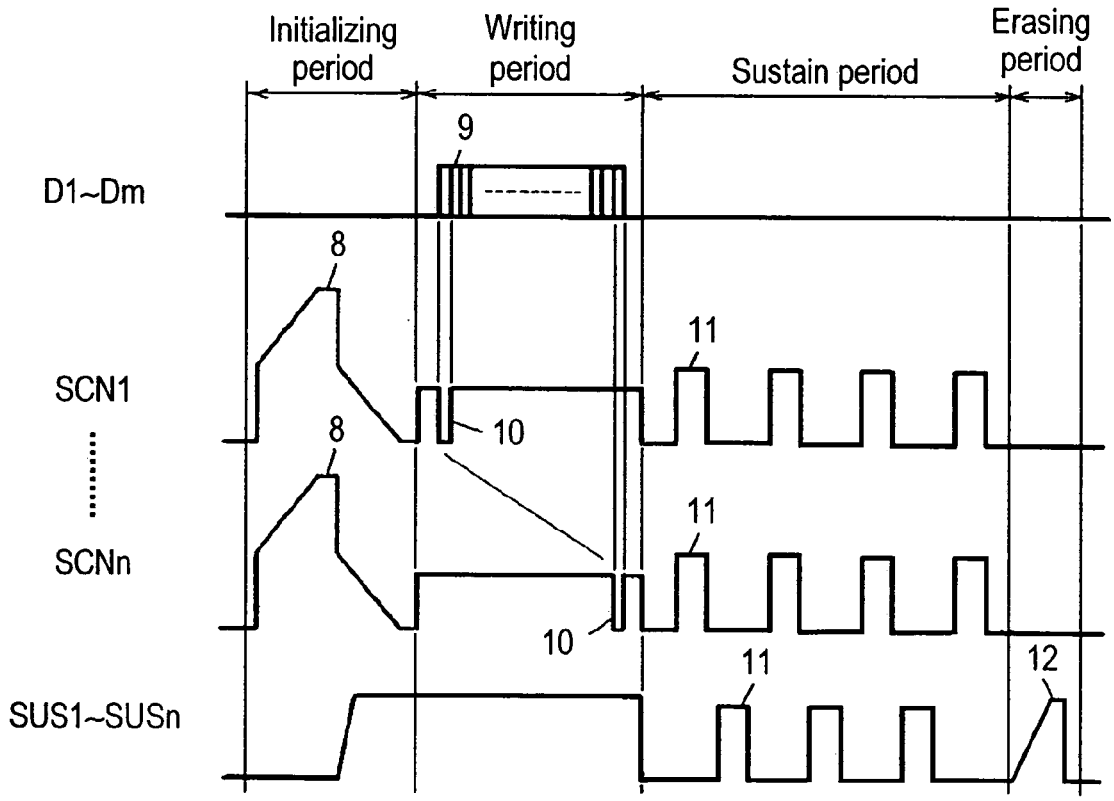
FIG. 2 is a driving waveform diagram of the plasma display device in FIG. 1.

The plasma display device shown in FIG. 1 is driven by a drive waveform as shown in FIG. 2. That is, first in the initializing period, by applying an initializing waveform 8 from scanning electrode SCN1 to SCNn, the wall charge in the panel is initialized to a state suited to write discharge. In the subsequent write period, by applying a writing pulse 9 from data electrode D1 to Dm, and applying a scanning pulse 10 from scanning electrode SCN1 to SCNn, write discharge is operated. In the subsequent sustain period, by applying a sustain pulse 11 alternately from scanning electrode SCN1 to SCNn, and from sustain electrode SUS1 to SUSn, sustain discharge is operated in discharge cells having operated write discharge, and display is illuminated. In the next erasing period, by applying an erasing waveform 12 from sustain electrode SUS1 to SUSn, sustain discharge is stopped.

Figure 3:
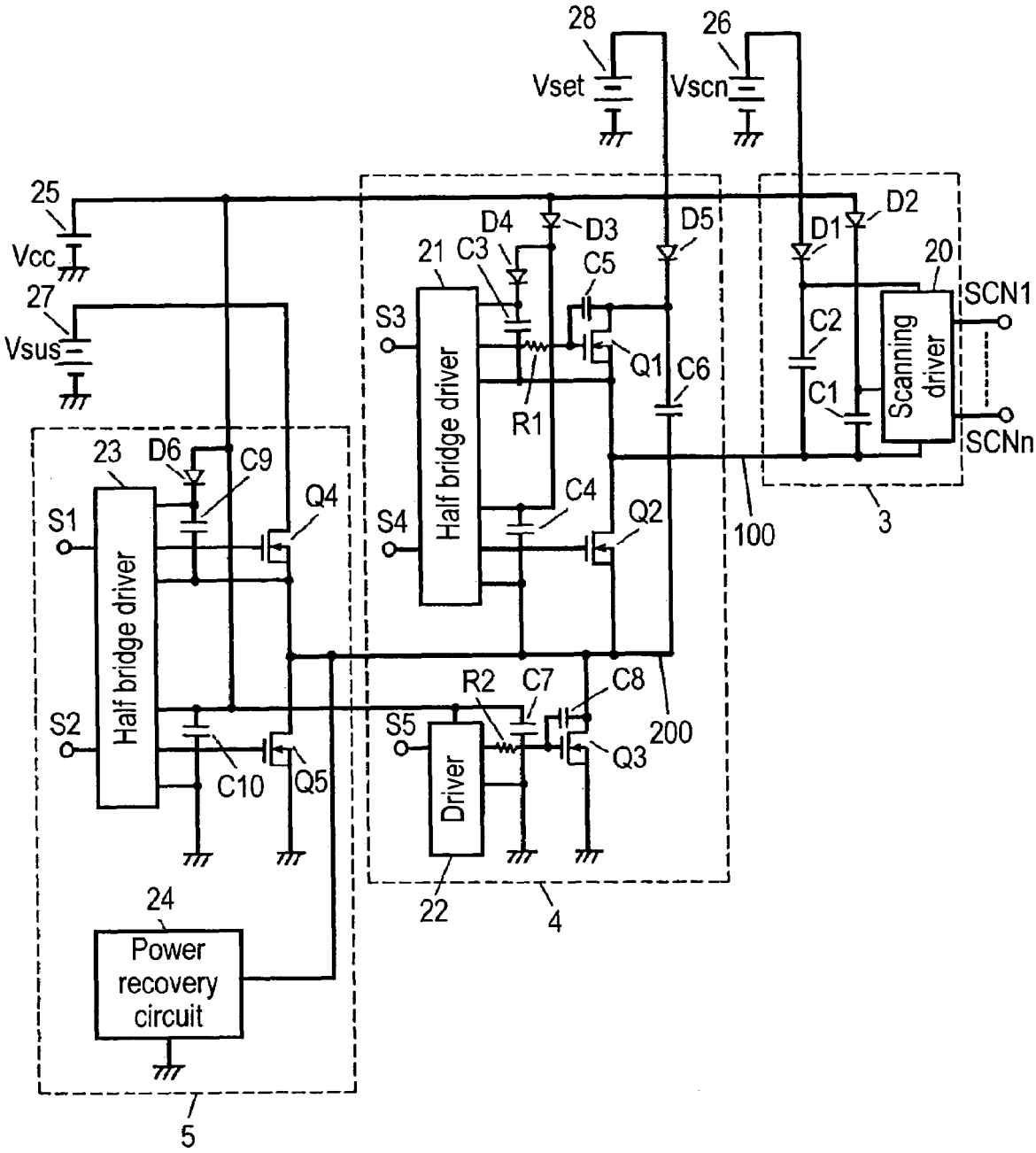
FIG. 3 is a circuit diagram showing an example of scanning electrode drive circuit of the plasma display device in FIG. 1.

In FIG. 1, the scanning electrode drive circuit 50 is specifically composed as shown in FIG. 3. In FIG. 3, the scanning circuit 3 connected from scanning electrode SCN1 to SCNn is composed of scanning driver 20, diodes D1, D2, and capacitors C1, C2.

The initializing circuit 4 connected to the scanning circuit 3 is a circuit for generating an initializing waveform 8 shown in FIG. 2, and it is composed of half bridge driver 21, driver 22, FETs Q1 to Q3, diodes D3 to D5, capacitors C3 to C8, and resistors R1 and R2.

The sustain circuit 5 connected to the scanning circuit 3 is a circuit for generating a sustain pulse 11 shown in FIG. 2 (sustain pulse applied from scanning electrode SCN1 to SCNn), and is composed of half bridge driver 23, power recovery circuit 24, FETs Q4, Q5, diode D6, and capacitors C9, C10.

A logic power source 25 is to feed supply voltage for operation to scanning driver 20, half bridge drivers 21, 23, and driver 22. A scanning pulse power source 26 is to generate a scanning pulse 10. A sustain pulse power source 27 is to generate a sustain pulse 11. An initializing wave power source 28 is to generate an initializing waveform 8.

That is, as shown in FIG. 3, the scanning circuit 3 connected from the scanning electrode SCN1 to SCNn is composed of scanning driver 20 for generating a scanning pulse, a bootstrap circuit for charging the capacitor C1 with the voltage of logic power source 25 through diode D2 and FET Q2, FET Q5, and a bootstrap circuit for charging the capacitor C2 with the voltage of scanning pulse power source 26 through diode D1 and FET Q2, FET Q5.

The initializing circuit 4 of which output line is connected to a negative side power feed line 100 of the scanning circuit 3 is composed of a Miller integrating circuit having FET Q1, capacitor C5, and resistor R1 for generating an ascending gradient waveform of initializing waveform 8, FET Q2 for bringing down the initializing waveform 8, a half bridge driver 21 for driving the FETs Q1, Q2, a bootstrap circuit for charging the capacitor C4 with the voltage of logic power source 25 of this half bridge driver 21 through diode D3 and FET Q5, a bootstrap circuit for charging the capacitor C3 with the voltage of logic power source 25 through diode D3, diode D4, FET Q2 and FET Q5, a bootstrap circuit for charging the capacitor C6 with the voltage of initializing waveform power source 28 through diode D5 and FET Q5, a Miller integrating circuit having FET Q3, capacitor C8, and resistor R2 for generating a descending gradient waveform of initializing waveform 8, a driver 22 for driving the FET Q3, and a bypass capacitor C7 for logic power source 25 as power source for this driver 22.

The sustain circuit 5 of which outline is connected to the source of the FET Q2 of initializing circuit 4 and the negative side power feed line 200 of half bridge driver 21 is composed of FET Q4 for supplying high level voltage of sustain pulse 11 and voltage of lower base portion of ascending gradient waveform of initializing waveform from sustain pulse power source 27, FET Q5 for supplying low level voltage of sustain pulse 11, half bridge driver 23 for driving the FETs Q4 and Q5, capacitor C10 for bypass of logic power source 25, bootstrap circuit for charging the capacitor C9 with voltage of logic power source 25 as power source of half bridge driver 23 through diode D6 and FET Q5, and power recovery circuit 24 for decreasing the switching loss by making use of LC resonance with electrode capacity of panel when switching the sustain pulse 11.

In the half bridge drivers 21, 23 and driver 22, S1 is a control signal input terminal to FET Q4, S2 to FET Q5, S3 to FET Q1, S4 to FET Q2, and S5 to FET Q3.

In the circuit having such configuration, circuits of which negative side power feed lines 100, 200 are connected to output of other circuits, that is, of the scanning circuit 3 and initializing circuit 4, a block composed of half bridge driver 21 and FETs Q1, Q2, and of the sustain circuit 5, a block composed of high side of half bridge driver 23 and FET Q4 are floating circuits. Power source of these floating circuits are voltage charged in the capacitors C2, C3, C4, C6, C7, C9 of the bootstrap circuit.

Figure 4:
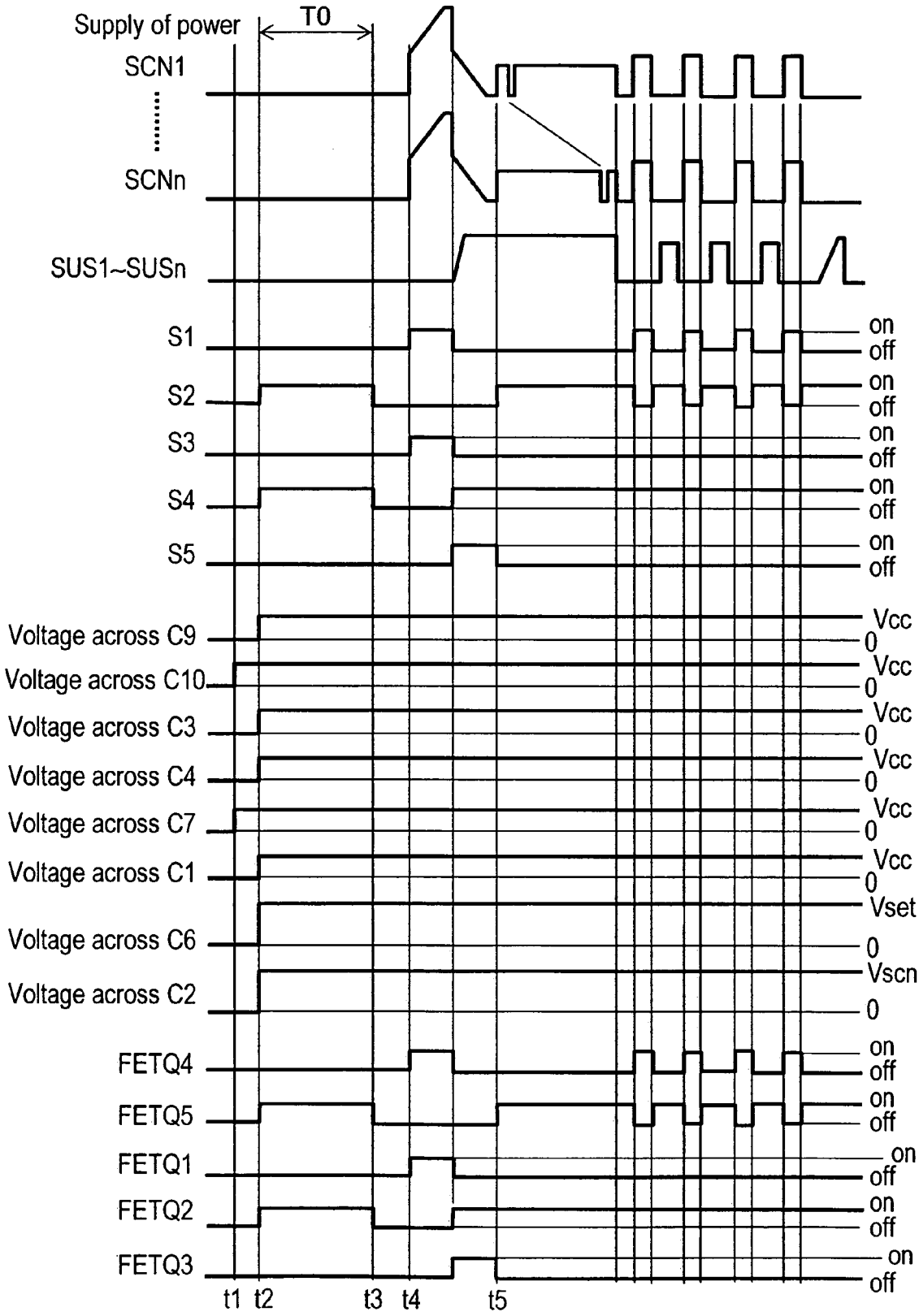
FIG. 4 is a timing diagram for explaining the operation sequence of the scanning electrode drive circuit in FIG. 3.

FIG. 4 shows the operation sequence after supply of power in the circuit shown in FIG. 3. In FIG. 4, when power is turned on at time t1, the logic power source 25 is turned on, and the voltage of capacitor C10 and voltage of capacitor C7 are turned on. At this time, an off logic is entered in control signals fed to the terminals S1, S2, S3, S4, S5.

At time t2, an on logic is entered in the terminals S2, S4. At this time, the voltage of the capacitor C10 has been already turned on at time t1, the half bridge driver 23 sends an on signal to the FET Q5. As a result, the voltage of the capacitors C9, C6 is turned on. The voltage of the capacitor C4 is also turned on, and an on logic is entered in the terminal S4, and hence the half bridge driver 21 sends an on signal to the FET Q2. When the FET Q2 is turned on, the voltage of the capacitors C3, C1, C2 is turned on.

At time t3, an off logic is entered in the terminals S2, S4. At time t4, an on logic is entered in the terminals S1, S3, and the voltages of the capacitors C9, C3 are turned on, and hence the half bridge drivers 21, 23 send an on signal to the FETs Q4, Q1. At this time, the voltage of the capacitor C6 has been already turned on. Therefore, the FET Q4 is turned on, and a Vsus voltage of initializing waveform 8 is applied from the scanning electrode SCN1 to SCNn, the FET Q1 is turned on, and an ascending gradient waveform portion of initializing waveform 8 is applied from scanning electrode SCN1 to SCNn.

At time t5, an off logic is entered in the terminals S1, S3, and an on logic is entered in the terminals S4, S5, and since the voltage of the capacitor C4 has been already turned on, the half bridge driver 21 sends an on signal to the FET Q2. Since the capacitor C7 has been already turned on, the driver 22 sends an on signal to the FET Q3, and a descending gradient waveform is issued.

Thus, in the circuit in FIG. 3, after supply of power, period T0 is provided, as shown in FIG. 4, from floating circuit power starting time t2 until time t3, and after the lapse of period T0, initializing waveform 8 is issued. After output of initializing waveform 8, in the subsequent writing period, scanning pulse 10 is issued, and in the sustain period, sustain pulse 11 is issued, and these pulses are applied from scanning electrode SCN1 to SCNn.

Thus, in the plasma display device of the invention, in a specified time T0 after supply of power, driving waveforms are issued (such as initializing waveform 8, writing pulse 9, scanning pulse 10, sustain pulse 11, erasing waveform 12). As a result, initializing waveform 8 can be securely applied from the scanning electrode SCN1 to SCNn, and the electric charge remaining in the discharge cells can be completely eliminated by the initializing operation, and undesired discharge does not occur in the subsequent sustain operation, so that the display quality in start can be enhanced.

INDUSTRIAL APPLICABILITY

The invention presents a plasma display device capable of preventing occurrence of undesired discharge upon start, and further enhanced in the display quality.

The invention claimed is:

1. A plasma display device comprising:

a plasma display panel forming discharge cells at intersections between data electrodes and both of scanning electrodes and sustain electrodes; and a scanning electrode drive circuit for applying an initializing waveform to the scanning electrodes to begin an initialization period for the plasma display device, said initializing waveform being applied to the scanning electrodes after a lapse of a specified period of time, said specified period time occurring after supplying power to the plasma display panel, wherein the scanning electrode drive circuit includes a floating circuit, and the specified time period includes a first time period until supplying power to the floating circuit after supplying power to the plasma display panel and a second time period after supplying the power to the floating circuit.

2. The plasma display device of claim 1, wherein the scanning electrode drive circuit includes a scanning circuit connected to the scanning electrodes, an initializing circuit connected to the scanning circuit for generating the initializing waveform, and a sustain circuit connected to the scanning circuit for generating a sustain pulse.

3. The plasma display device of claim 1, wherein the driving waveform issued by the scanning electrode drive circuit includes an initializing waveform to be applied to the scanning electrodes.

* * * * *